US007604316B2

(12) United States Patent
Terekhov et al.

(10) Patent No.: US 7,604,316 B2
(45) Date of Patent: Oct. 20, 2009

(54) METHOD AND APPARATUS FOR COMPENSATING FOR MALFUNCTIONING NOZZLE AND INKJET IMAGE FORMING APPARATUS USING THE SAME

(75) Inventors: Vladislav Terekhov, Suwon-si (KR); Ki-Min Kang, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 247 days.

(21) Appl. No.: 11/582,435

(22) Filed: Oct. 18, 2006

(65) Prior Publication Data

US 2007/0126765 A1 Jun. 7, 2007

(30) Foreign Application Priority Data

Dec. 6, 2005 (KR) ..... 10-2005-0118015

(51) Int. Cl.
*B41J 29/38* (2006.01)

(52) U.S. Cl. ..... 347/14; 347/12

(58) Field of Classification Search ..... 347/14
See application file for complete search history.

(56) References Cited

U.S. PATENT DOCUMENTS 5,581,284 A 12/1996 Hermanson
2004/0119766 A1 * 6/2004 Shibata et al. ..... 347/12

FOREIGN PATENT DOCUMENTS

| | | |
|---|---|---|
| JP | 2001-146004 | 5/2001 |
| JP | 2002-144549 | 5/2002 |
| JP | 2002-200788 | 7/2002 |
| KR | 1997-010131 | 3/1997 |

* cited by examiner

*Primary Examiner*—Matthew Luu
*Assistant Examiner*—Brian J Goldberg
(74) *Attorney, Agent, or Firm*—Roylance, Abrams, Berdo & Goodman, LLP

(57) ABSTRACT

A method and apparatus are provided for compensating for the degradation of a print image due to a malfunctioning nozzle that irregularly ejects ink. A malfunctioning nozzle is detected among nozzles installed in an inkjet image forming apparatus, and image data of a print position adjacent to a compensation position printed by the malfunctioning nozzle is exchanged for image data of a print position in an interest or inspection region near the compensation position. Accordingly, degradation of print quality, such as, for example, an unintended visible white band, can be prevented and the lifetime of the printhead can be lengthened.

6 Claims, 11 Drawing Sheets

METHOD AND APPARATUS FOR COMPENSATING FOR MALFUNCTIONING NOZZLE AND INKJET IMAGE FORMING APPARATUS USING THE SAME

CROSS-REFERENCE TO RELATED PATENT APPLICATIONS

This application claims the benefit under 35 U.S.C. § 119(a) of Korean Patent Application No. 10-2005-0118015, filed Dec. 6, 2005, in the Korean Intellectual Property Office, the entire disclosure of which is hereby incorporated by reference.

BACKGROUND OF THE INVENTION

1. Field of the Invention

The present invention relates to an inkjet image forming apparatus. More particularly, the present invention relates to a method and apparatus for an inkjet image forming apparatus which can compensate for image degradation caused by malfunctioning nozzles, and an inkjet image forming apparatus using the same.

2. Description of the Related Art

An inkjet image forming apparatus forms images by ejecting ink from a printhead, which is placed a predetermined distance from a print medium and reciprocally moves in a direction perpendicular to a transferring direction of the print medium. Such an inkjet image forming apparatus is referred to as a shuttle-type inkjet image forming apparatus. A nozzle unit having a plurality of nozzles for ejecting ink is installed in a printhead of the shuttle-type inkjet image forming apparatus.

Recently, a printhead having a nozzle unit with a length corresponding to the width of a print medium has been used to obtain high-speed printing. An image forming apparatus operated in this manner is referred to as a line-printing-type inkjet image forming apparatus. In the line-printing-type inkjet image forming apparatus, a printhead is fixed and only the print medium is transferred. Accordingly, a driving device of an inkjet image forming apparatus is simple and high-speed printing can be performed.

FIG. 1 shows printing patterns obtained when the nozzle of a conventional inkjet image forming apparatus malfunctions. FIGS. 2A through 2D are pixel images for explaining a conventional method of compensating for a malfunctioning nozzle of the conventional inkjet image forming apparatus.

Referring to FIG. 1, the inkjet image forming apparatus forms an image by ejecting ink I from nozzles 82 formed in a nozzle unit 80 onto a print medium. When a nozzle 84 malfunctions, the malfunctioning nozzle 84 irregularly ejects ink I so that a missing line appears on the print medium, as illustrated in FIG. 1. That is, when a malfunctioning nozzle 84 exists among the plurality of nozzles 82, a missing line, such as a visible white line, will appear on the print medium because the malfunctioning nozzle irregularly ejects ink. Thus, printing quality is degraded by the presence of the missing line.

A method of compensating for image quality degradation due to a malfunctioning nozzle is disclosed in U.S. Pat. No. 5,581,284, from which FIGS. 3 through 6 are reproduced herein as FIGS. 2A through 2D, and which is incorporated herein by reference.

U.S. Pat. No. 5,581,284 discloses a method of compensating a malfunctioning nozzle in an inkjet image forming apparatus. The malfunctioning nozzle indicates a bad or non-droplet ejecting nozzle. When, for example, a black ink nozzle 63 is identified as malfunctioning, ink droplets of other colors, that is cyan, magenta, and yellow, are sequentially ejected to a region in which the malfunctioning nozzle should have ejected black ink. These processes are illustrated in FIGS. 2B, 2C, and 2D.

As described above, the black color can be represented by printing the cyan, magenta, and yellow ink droplets at the same location on the print medium where black should have printed, and the represented color is called "process black" or "composite black." Although this method of compensation is useful to compensate for malfunction of a nozzle ejecting black ink, it is not possible to compensate for malfunction of nozzles ejecting other colors. Further, when one of the nozzles used for compensation malfunctions, other colors such as red (yellow+magenta), green (cyan+yellow), or blue (cyan+magenta) are printed. Thus, printing quality is deteriorated. Hence, there is a need for compensation of malfunctioning nozzles to improve the image quality.

SUMMARY OF THE INVENTION

Exemplary embodiments of the present invention provide a method and apparatus for compensating for a malfunctioning nozzle that can effectively compensate for image degradation caused by malfunctioning nozzles to enhance printing quality, and an inkjet image forming apparatus using the same.

Exemplary embodiments of the present invention provide a method of compensating for a malfunctioning nozzle of an inkjet image forming apparatus. The method includes detecting a malfunctioning nozzle in an inkjet image forming apparatus having a plurality of nozzles, and exchanging image data of a print position adjacent to a compensation position printed by the malfunctioning nozzle for image data of a print position in an interest region near the compensation position.

In an exemplary implementation, the exchanging of image data can include detecting among a plurality of print positions in the interest region a print position having the same color as the compensation position; and exchanging image data of the detected print position for image data of one of the adjacent print positions leftward and rightward of the compensation position. The print position adjacent to the compensation position can have a different color from those of the compensation position and one of the adjacent print positions leftward and rightward of the compensation position.

In an exemplary implementation, the exchanging of image data can include detecting among a plurality of print positions in the interest region a print position having a different color from the compensation position, and exchanging image data of the detected print position for image data of one of the adjacent print positions upward and downward from the compensation position. In detecting the print position, a print position having a different color from white, cyan, magenta, or yellow can be detected among the plurality of print positions in the interest region. The print position adjacent to the compensation position can be one of the adjacent print positions upward and downward from the compensation position, and have one color of white, cyan, magenta, and yellow.

In an exemplary implementation, the exchanging of image data can include detecting among a plurality of print positions in the interest region a print position having the same color as that which the malfunctioning nozzle prints, and exchanging image data of the detected print position for image data of one of the adjacent print positions leftward and rightward of the compensation position. The print position adjacent to the compensation position can be one of the adjacent print positions upward and downward from the compensation position, and has white color.

Exemplary embodiments of the present invention provide an apparatus for compensating for a malfunctioning nozzle of an inkjet image forming apparatus, the apparatus includes a malfunctioning nozzle detecting unit for detecting a malfunctioning nozzle among a plurality of nozzles, and a control unit for exchanging image data of a print position adjacent to a compensation position printed by the malfunctioning nozzle for image data of a print position in an interest region near the compensation position.

In an exemplary implementation, the control unit can include a print position detecting unit for detecting among a plurality of print positions in the interest region a print position having the same color as the compensation position, and a data exchanging unit for exchanging image data of the detected print position for image data of one of the adjacent print positions leftward and rightward of the compensation position. The print position adjacent to the compensation position can have a different color from the compensation position and one of the adjacent print positions leftward and rightward of the compensation position.

In an exemplary implementation, the control unit can include a print position detecting unit for detecting among a plurality of print positions in the interest region a print position having a different color from the compensation position, and a data exchanging unit for exchanging image data of the detected print position for image data of one of the adjacent print positions upward and downward from the compensation position. The print position detecting unit can detect a print position having a different color from white, cyan, magenta, or yellow among the plurality of print position in the interest region. The print position adjacent to the compensation position can be one of the adjacent print positions upward and downward from the compensation position, and have one color of white, cyan, magenta, and yellow.

In an exemplary implementation, the control unit can include a print position detecting unit for detecting among a plurality of print positions in the interest region a print position having the same color as that of the malfunctioning nozzle, and a data exchanging unit for exchanging image data of the detected print position for image data of one of the adjacent print positions leftward and rightward of the compensation position. The print position adjacent to the compensation position can be one of the adjacent print positions leftward and rightward of the compensation position, and have one color of white, cyan, magenta, and yellow.

Exemplary embodiments of the present invention provide an image forming apparatus for receiving image data and printing an image using a plurality of nozzles. The image forming apparatus includes a printhead comprising a plurality of nozzles that eject ink to form an image on a print medium, a malfunctioning nozzle detecting unit for detecting a malfunctioning nozzle among the plurality of nozzles, a control unit for exchanging image data of a print position adjacent to a compensation position printed by the malfunctioning nozzle for image data of a print position in an interest region near the compensation position, and for generating a control signal for driving the plurality of nozzles in response to the exchanged image data; and a nozzle driving unit for driving the plurality of nozzles in response to the generated control signal.

In an exemplary implementation, the control unit can include a print position detecting unit for detecting among a plurality of print positions in the interest region a print position having the same color that the malfunctioning nozzle prints, and a data exchanging unit for exchanging image data of the detected print position for image data of one of the adjacent print positions leftward and rightward of the compensation position.

In an exemplary implementation, the control unit can include a print position detecting unit for detecting among a plurality of print positions in the interest region a print position having the same color as the compensation position, and a data exchanging unit for exchanging image data of the detected print position for image data of one of the adjacent print positions leftward and rightward of the compensation position.

In an exemplary implementation, the control unit can include a print position detecting unit for detecting among a plurality of print positions in the interest region a print position having the same color as that of the malfunctioning nozzle, and a data exchanging unit for exchanging image data of the detected print position for image data of one of the adjacent print positions leftward and rightward of the compensation position.

The method of compensating for a malfunctioning nozzle can be embodied as a computer program recorded on a computer readable medium.

BRIEF DESCRIPTION OF THE DRAWINGS

The above and other exemplary features and advantages of the present invention will become more apparent from the following detailed description of certain exemplary embodiments thereof when taken in conjunction with the accompanying drawings, in which.

Throughout the drawings, like reference numbers should be understood to refer to like elements, features, and structures.

DETAILED DESCRIPTION OF EXEMPLARY EMBODIMENTS

Figure 1:
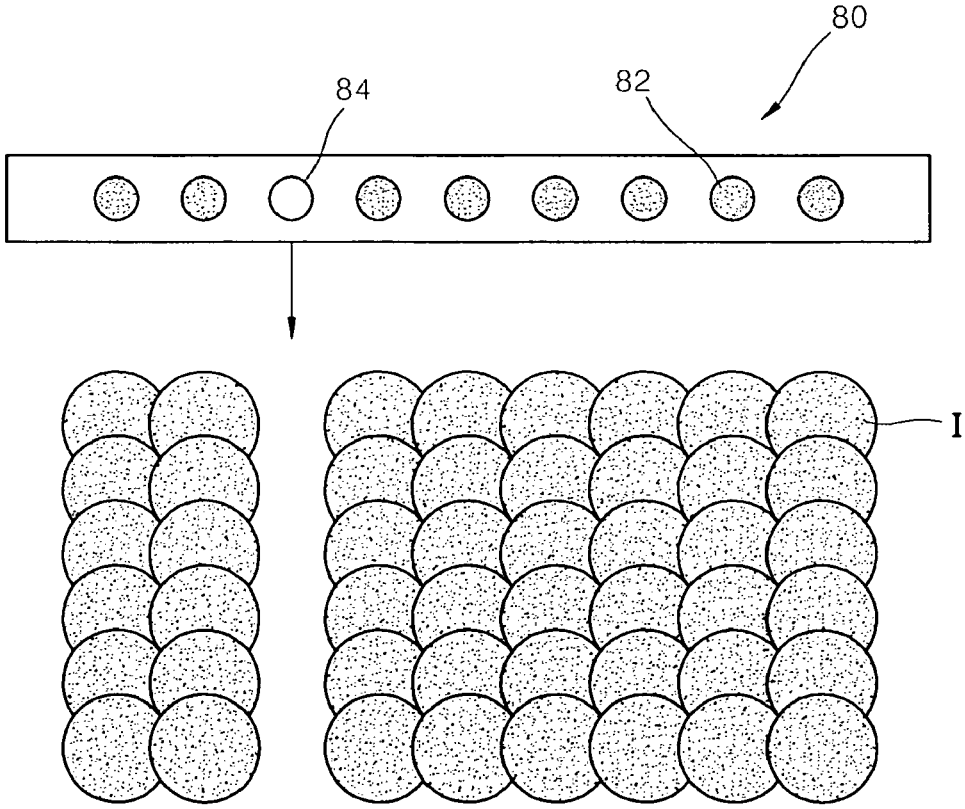
FIG. 1 (PRIOR ART)
FIG. 1 shows printing patterns when a nozzle unit of a conventional line-printing-type inkjet image forming apparatus malfunctions.
Figure 2A:
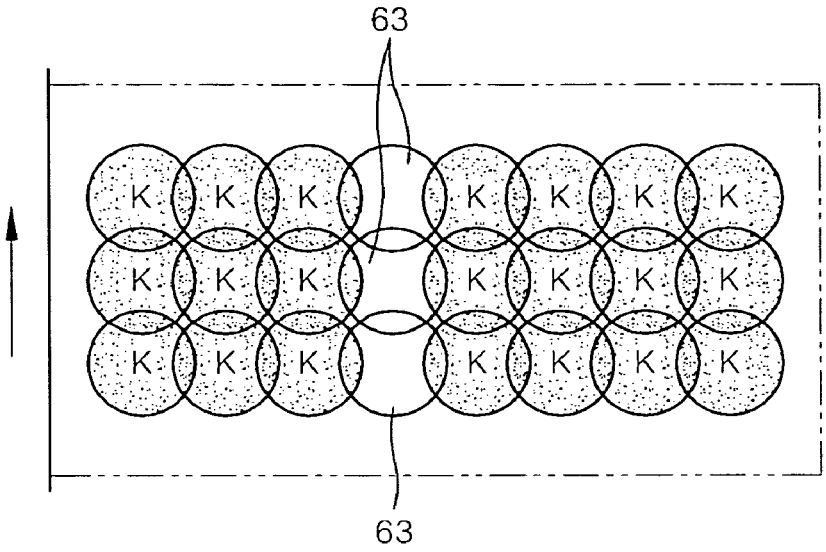
FIG. 2A (PRIOR ART)
FIGS. 2A through 2D are pixel images for explaining a conventional method of compensating a malfunctioning nozzle unit of a conventional inkjet image forming apparatus.
Figure 2B:
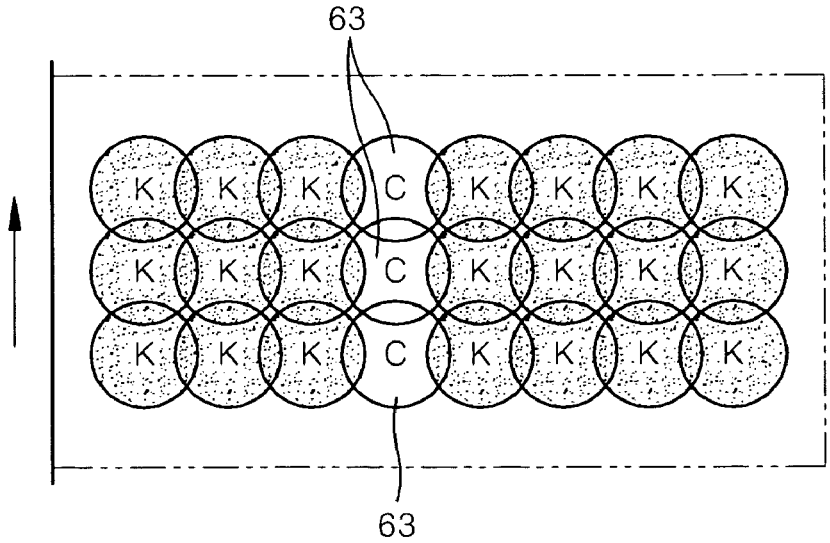
FIG. 2B (PRIOR ART)
Figure 2C:
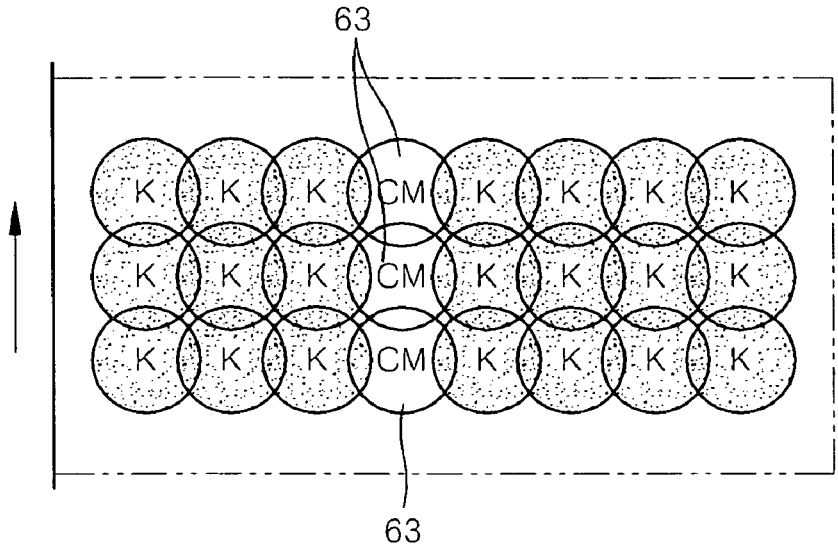
FIG. 2C (PRIOR ART)
Figure 2D:
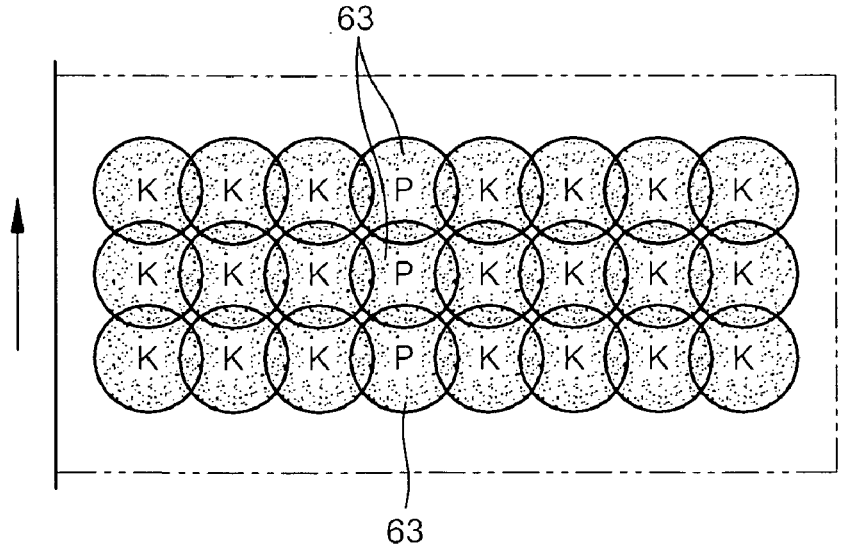
FIG. 2D (PRIOR ART)

The matters exemplified in this description are provided to assist in a comprehensive understanding of various exemplary embodiments of the present invention disclosed with reference to the accompanying figures. Accordingly, those of ordinary skill in the art will recognize that various changes and modifications of the exemplary embodiments described herein can be made without departing from the scope and spirit of the claimed invention. Descriptions of well-known functions and constructions are omitted for clarity and conciseness. In the drawings, the thicknesses of lines and sizes are exaggerated for clarity and convenience. Also, the terms used herein are defined according to the functions of the present invention. Thus, the terms may vary depending on users or operators and usages. That is, the terms used herein should be understood based on the descriptions made herein.

Figure 3:
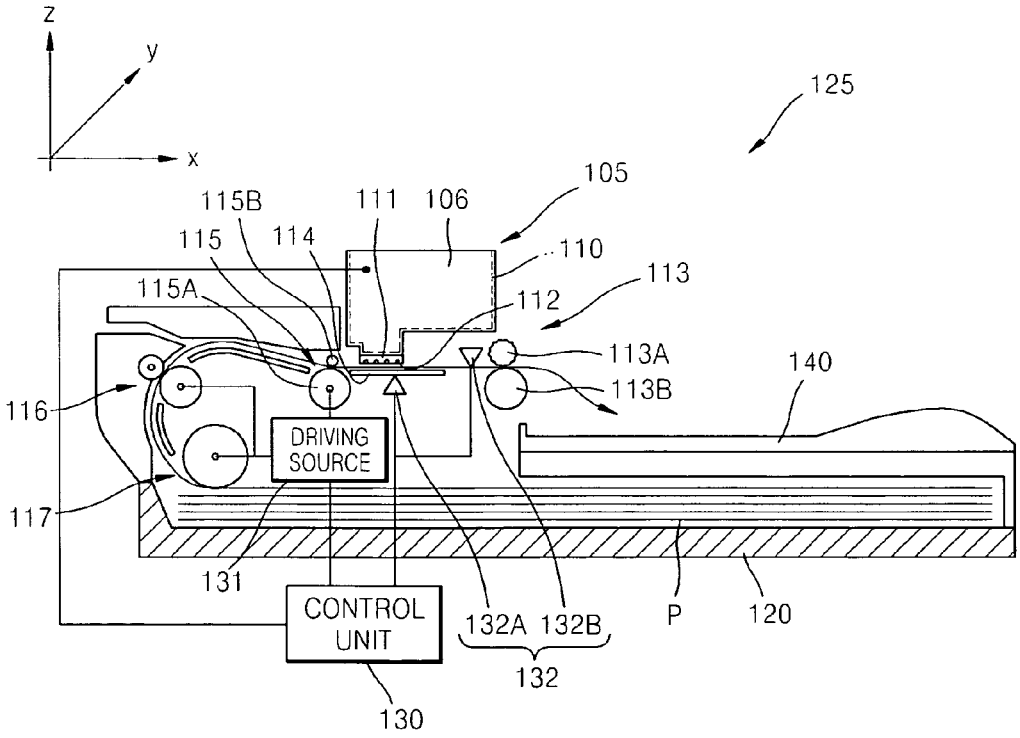
FIG. 3 is a schematic cross-sectional view of an inkjet image forming apparatus according to an exemplary embodiment of the present invention.

FIG. 3 is a schematic cross-sectional view of an inkjet image forming apparatus 125 according to an exemplary embodiment of the present invention.

Referring to FIG. 3, the inkjet image forming apparatus 125 includes a feeding cassette 120, a printhead unit 105, a supporting member 114 opposite to the printhead unit 105, a malfunctioning nozzle detecting unit 132 for detecting the generation and position of a malfunctioning nozzle, a print medium transferring unit for transferring a print medium P in a first direction, that is, an x-direction, and a stacking unit 140 on which the discharged print medium P is stacked. In addition, the inkjet image forming apparatus 125 further includes a nozzle driving unit 160 (see FIG. 4) and a control unit 130 for controlling each component thereof.

The print medium P is stacked on the feeding cassette 120. The print medium P is transferred from the feeding cassette 120 through a printhead 111 to the stacking unit 140 by the print medium transferring unit. The stacking unit 140 comprises, for example, a discharging paper tray, where the print medium P on which an image is formed is stacked after discharging.

The print medium transferring unit transfers the print medium P along a certain path, and includes a pick-up roller 117, an auxiliary roller 116, a feeding roller 115, and a discharging roller 113. The print medium transferring unit is driven by a driving source 131, such as a motor, and provides a transferring force to transfer the print medium P. The driving source 131 is controlled by the control unit 130.

The pick-up roller 117 is installed in one side of the feeding cassette 120 and picks up the print medium P stacked in the feeding cassette 120. The feeding roller 115 is installed at an inlet side of the printhead 111 and feeds the print medium P drawn out to the printhead 111 by the pick-up roller 117. The feeding roller 115 includes a driving roller 115A to supply a transferring force to transfer the print medium P, and an idle roller 115B elastically engaged with the driving roller 115A. The auxiliary roller 116 that transfers the print medium P may be further installed between the pick-up roller 117 and the feeding roller 115. The discharging roller 113 is installed at an outlet side of the printhead 111 and discharges the print medium P on which the printing has been completed to an outside of the image forming apparatus 125. The discharging roller 113 includes a star wheel 113A installed in a width direction of the print medium P, and a supporting roller 113B which is opposite to the star wheel 113A and supports a rear side of the print medium P. The star wheel 113A prevents the print medium P, fed in a downward direction of the nozzle unit 112, from contacting the bottom surface of the nozzle unit 112 or body 110. Star wheel 113A also prevents the distance between the print medium P and the bottom surface of the nozzle unit 112, or body 110, from being changed. The star wheel 113A is installed such that at least a portion of the star wheel 113A protrudes from the nozzle unit 112, and contacts at a point on a top surface of the print medium P. The discharged print medium P is stacked on the stacking unit 140.

The supporting member 114 is installed below the printhead 111 and supports the rear side of the print medium P to maintain a predetermined distance between the nozzle unit 112 and the print medium P. In one exemplary implementation, the distance between the nozzle unit 112 and the print medium P is about 0.5-2.5 mm.

The malfunctioning nozzle detecting unit 132 can detect a malfunctioning nozzle generated in the manufacturing process and during printing. In addition, the malfunctioning nozzle detecting unit 132 inspects ejecting operations of nozzles adjacent to the malfunctioning nozzle. That is, the malfunctioning nozzle detecting unit 132 inspects each nozzle in the nozzle unit 112, and a memory (not illustrated) stores the information about the ejecting operations of the nozzle. The malfunctioning nozzle detecting unit 132 indicates a bad or non-droplet ejecting nozzle. A malfunctioning nozzle is detected when ink is not ejected from the nozzle or when a smaller amount of ink droplets than usual are ejected.

The malfunctioning nozzle can be generated during the printhead 111 manufacturing process or during printing. In general, information on the malfunctioning nozzle generated during the manufacturing process is stored in a memory (not illustrated) installed in the printhead 111 and may be transmitted to the image forming apparatus 125 when the printhead is mounted in the image forming apparatus 125.

Printheads of inkjet image forming apparatuses are generally classified into two types according to an actuator that provides an ejecting force to ink droplets. The first type is a thermal driving printhead that generates bubbles in ink using a heater, thereby ejecting ink droplets due to an expanding force of the bubbles. The second type is a piezoelectric driving printhead that ejects ink droplets using pressure applied to the ink due to deformation of a piezoelectric device. When ink is ejected using thermal driving, malfunction can occur and be detected when, for example, a heater used for ejecting ink is disconnected, the driving circuit of the heater is broken, and when an electrical element of the nozzle, such as a filed effect transistor (FET), is damaged. Likewise, when ink is ejected using piezoelectric driving, defects of the piezoelectric device or nozzle malfunction occurring by damage to a driving circuit for driving the piezoelectric device can easily be detected.

Causes of a malfunctioning nozzle may not easily be detected, however, when the nozzle is clogged with foreign matter. When the causes of a malfunctioning nozzle cannot easily be detected, test page printing is performed. If a malfunctioning nozzle exists in the nozzle unit 112, due to missing dots, the print concentration of a portion of a print medium P printed by the malfunctioning nozzle is lower than a portion of the print medium P printed by a normal nozzle. Accordingly, the occurrence and position of a malfunctioning nozzle can be detected using the print concentration difference.

The malfunctioning nozzle detecting unit 132 includes a first detecting unit 132A and a second detecting unit 132B. In exemplary embodiments, the first detecting unit 132A detects whether nozzles are clogged by radiating light directly onto the nozzle unit 112, and the second detecting unit 132B detects whether a malfunctioning nozzle exists in the nozzle unit 112 by radiating light onto the print medium P when the print medium P is transferred. The malfunctioning nozzle detecting unit 132 includes an optical sensor. The optical sensor includes a light-emitting sensor, such as, for example, a light emitting diode, that radiates light onto the nozzle unit 112 or the print medium P. and the optical sensor also includes a light-receiving sensor that receives light reflected from the nozzle unit 112 or the print medium P. An output signal from the light-receiving sensor is supplied to the second detecting unit 132B.

The malfunctioning nozzle detecting unit 132 detects whether a malfunctioning nozzle exists in the nozzle unit 112 in response to the output signal transmitted from the light-receiving sensor. Information about whether the malfunctioning nozzle exists in the nozzle unit 112 is transmitted to the control unit 130. The light-emitting sensor and the light-receiving sensor can be formed as an integrated unit or several separate units. The structures and functions of the optical sensor are well known to those of ordinary skill in the art, and thus a detailed description thereof will be omitted.

Although not illustrated, in another exemplary embodiment of the present invention, the malfunctioning nozzle detecting unit 132 transmits nozzle inspection signals to the nozzle and detects the occurrence and position of a malfunctioning nozzle in response to the transmitted nozzle inspection signals.

The malfunctioning nozzle detecting unit 132 detects the generation and position of a malfunctioning nozzle using the above-described series of processes. Information of the malfunctioning nozzle detected by the malfunctioning nozzle detecting unit 132 can be stored in a memory (not illustrated). The control unit 130 controls the operation of each component of the image forming apparatus 125 to compensate for the malfunctioning nozzle according to the information of the malfunctioning nozzle. The information of the malfunctioning nozzle includes the position of a malfunctioning nozzle and ink color ejected from the malfunctioning nozzle.

The printhead unit 105 prints an image by ejecting ink onto the print medium P, and includes the body 110, the printhead 111 installed in one side of the body 110, the nozzle unit 112 formed on the printhead 111, and a carriage 106 where the body 110 is mounted. The body 110 is mounted into the carriage 106 in a cartridge type manner. The feeding roller 115 is rotatably installed at an inlet side of the nozzle unit 112, and the discharging roller 113 is rotatably installed at an outlet side of the nozzle unit 112.

Although not illustrated, an ink container for storing ink is provided in the body 110. Further, the body 110 may include chambers, each of which has nozzle driving unit (for example, piezoelectric element type or heat-driving type heaters) that are connected to respective nozzles of the nozzle units 112 and provide pressure to eject the ink, a passage (for example, an orifice) for supplying the ink contained in the body 110 to each chamber, a manifold that is a common passage for supplying the ink through the passage to the chamber, and a restrictor that is an individual passage for supplying ink from the manifold to each chamber. The chamber, the ejecting unit, the passage, the manifold, and the restrictor are well-known to a person of ordinary skill in the art, and thus detailed descriptions thereof will be omitted. In addition, the ink container (not illustrated) may be separately installed from the printhead unit 105. The ink stored in the ink container (not illustrated) may be supplied to the printhead unit 105 through a supplying unit such as, for example, a hose.

Figure 4:
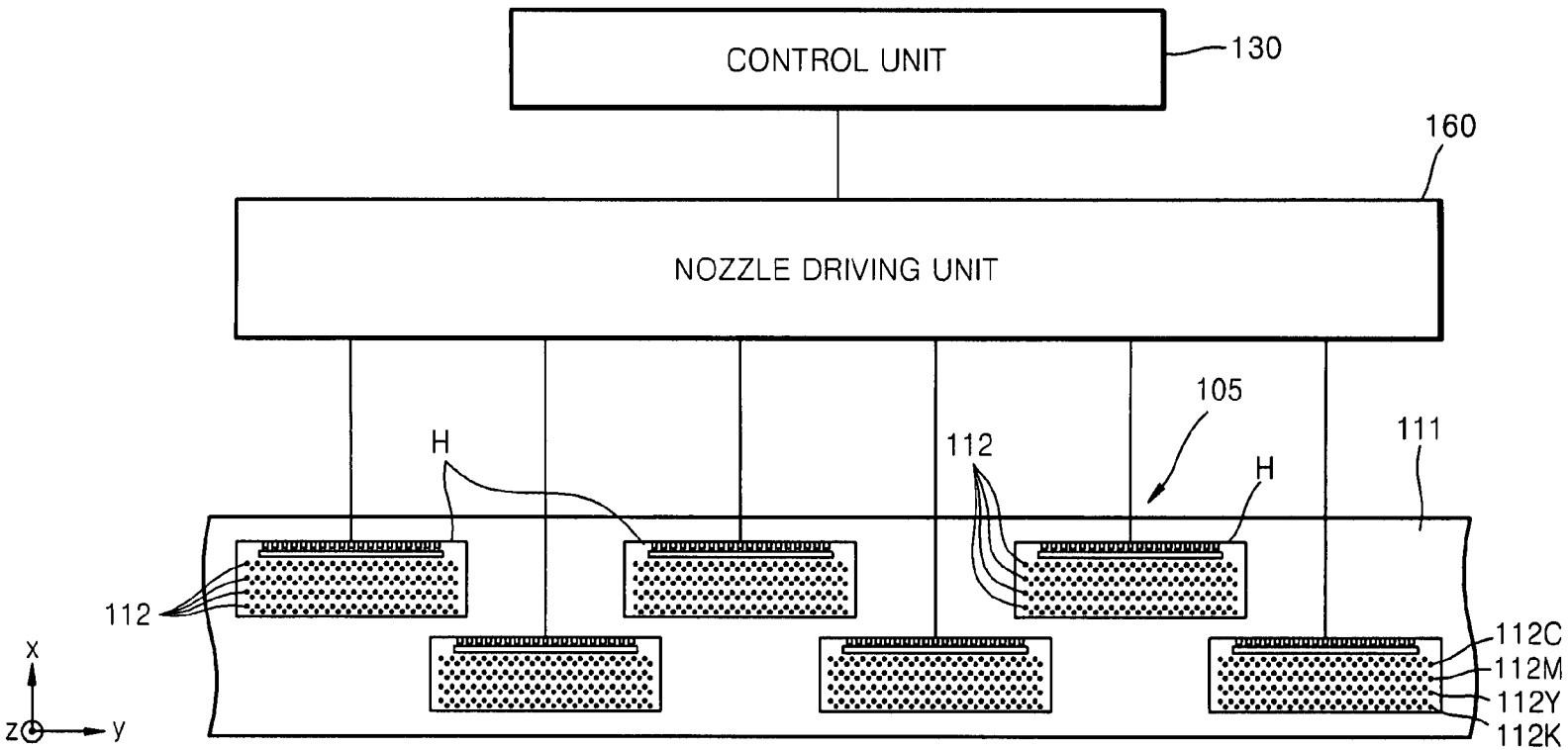
FIG. 4 illustrates the structure of a nozzle driving unit that drives a plurality of nozzles in a printhead according to an exemplary embodiment of the present invention.

FIG. 4 illustrates the structure of a nozzle driving unit that drives a plurality of nozzles in a printhead. Referring to FIG. 4, a method of driving the printhead will be described.

The nozzle driving unit 160 provides an ejecting force to ink droplets, and drives the printhead 111 at a certain frequency to print an image on the print medium P. The nozzle driving units 160 are classified into two types according to an actuator that provides an ejecting force to ink droplets. The first type is a thermal driving printhead that ejects ink droplets using a heater. The second type is a piezoelectric driving printhead that ejects ink droplets using a piezoelectric device. The nozzle driving unit 160 driving the nozzles in the nozzle unit 112 is controlled by the control unit 130.

In general, the printheads 111 are classified into two types: a shuttle-type inkjet image forming apparatus prints an image using a printhead that reciprocally moves in a direction perpendicular to a transferring direction of the print medium, and a line-printing-type inkjet image forming apparatus having the printhead with a length corresponding to the width of a print medium. Exemplary embodiments of the present invention can be applied to a shuttle-type inkjet image forming apparatus or a line-printing-type inkjet image forming apparatus. Hereinafter, for convenience of explanation, an example is described featuring a printhead in a line-printing-type inkjet image forming apparatus.

The printhead 111 is installed along a second direction, the y-direction, with respect to the print medium P transferring ink along a first direction, the x-direction. The printhead 111 uses heat energy or a piezoelectric device as an ink ejecting source, and is made to have a high resolution through a semiconductor manufacturing process such as etching, deposition, or sputtering. The printhead unit 111 includes a nozzle unit 112 which prints an image by ejecting ink onto the print medium P.

The nozzle unit 112 can have a length equal to or longer than the width of the print medium P. Referring to FIG. 4, a plurality of head chips H having a plurality of nozzle row arrays 112C, 112M, 112Y, and 112K can be formed in the printhead 111. The reference numeral 112C denotes a cyan nozzle array, the reference numeral 112M denotes a magenta nozzle array, the reference numeral 112Y denotes a yellow nozzle array, and the reference numeral 112K denotes a black nozzle array. Each of the head chips H may be formed of one chip having a length equal to that of the printhead 111, that is, the width of the print medium P.

In exemplary embodiments, a line-printing-type printhead 111, including a nozzle unit 112 having a plurality of head chips H, is described as an example, but the printhead according to the present invention can be variously formed. For example, an inkjet image forming apparatus 125 can include a shuttle-type printhead. Therefore, the printhead 111 and the nozzle unit 112 illustrated in FIG. 4 do not limit the technical scope of the prevent invention.

Figure 5:
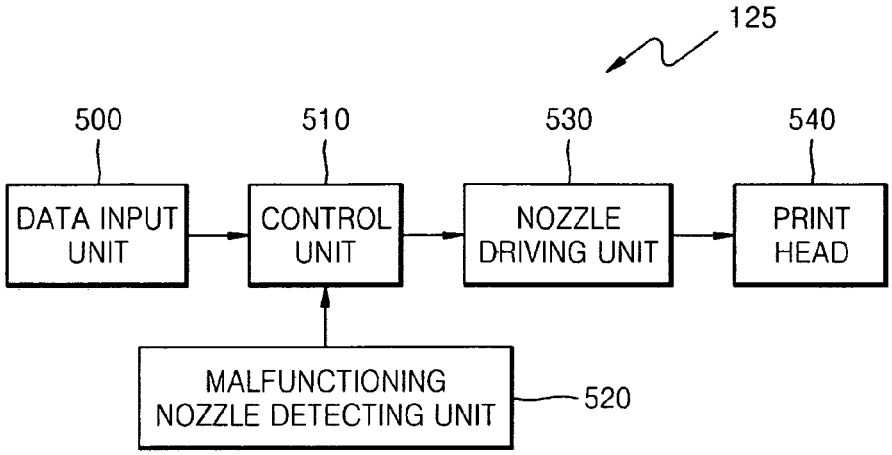
FIG. 5 is a block diagram illustrating an inkjet image forming apparatus having an apparatus for compensating for a malfunctioning nozzle according to an exemplary embodiment of the present invention.

FIG. 5 is a block diagram illustrating an inkjet image forming apparatus 125 having an apparatus for compensating for a malfunctioning nozzle according to an exemplary embodiment of the present invention. The image forming apparatus 125 includes a data input unit 500, a control unit 510, a malfunctioning nozzle detecting unit 520, a nozzle driving unit 530 and a printhead 540.

The data input unit 500 receives image data from sources that include a personal computer (PC), a digital camera, or a personal digital assistant (PDA).

The control unit 510 controls operations of the image forming apparatus 125 for printing an image. The malfunctioning nozzle detecting unit 520 inspects ejection states of nozzles installed in the printhead 540, detects a malfunctioning nozzle, and generates and outputs information including, for example, the position of the detected malfunctioning nozzle. Exemplary embodiments of the present invention proving the methods of detecting a malfunctioning nozzle and generating information of the malfunctioning nozzle by the malfunctioning nozzle detecting unit 520 have been described with reference to FIG. 3, and thus will be omitted.

The control unit 510 can be installed on a computer board of the image forming apparatus 125. The control unit 510 generates a control signal having information of a driving status for each nozzle using the inputted image data and transmits the control signal to the nozzle driving unit 530.

The control unit 510 receives information of the malfunctioning nozzle, and exchanges image data of one print position among print positions adjacent to the compensation position for a malfunctioning nozzle for image data of a print position in an interest region. The compensation position corresponds to a print position where a malfunctioning nozzle prints when the malfunctioning nozzle regularly ejects ink on a print medium P. The adjacent print positions are disposed to the left, right, above, and below the compensation position.

Figure 7:
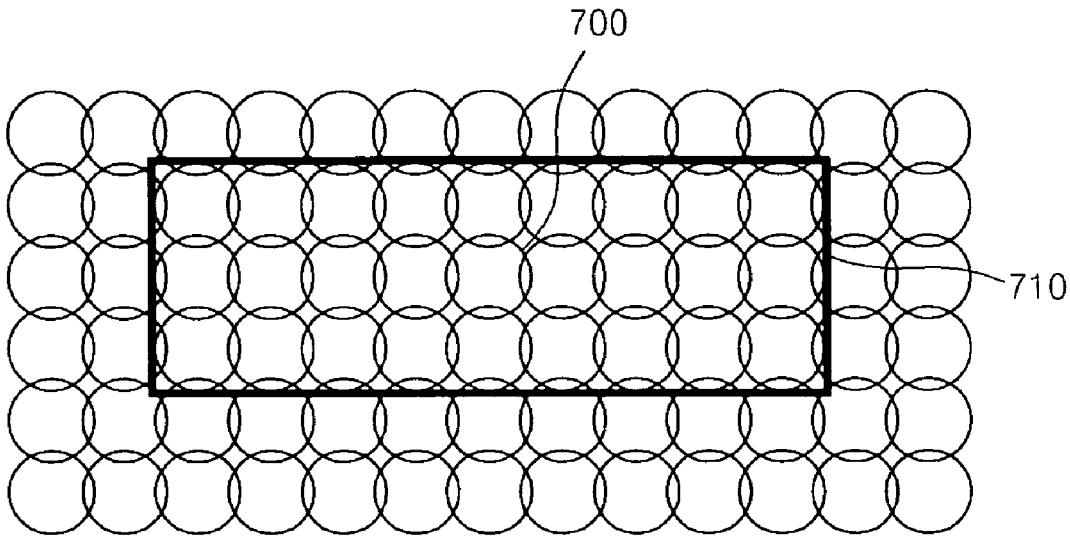
FIG. 7 illustrates a method of setting an interest region near a compensation area printed by a malfunctioning nozzle, according to an exemplary embodiment of the present invention.

FIG. 7 illustrates a method of setting an interest region 710 near a compensation position printed by a malfunctioning nozzle, according to an exemplary embodiment of the present invention. The interest region 710 illustrated in FIG. 7 is a rectangle with a height of three print positions and a length of nine print positions. The compensation position 700 is disposed at the center of the interest region 710. The size and position of the interest region 710 can be variously set-up according to a default value when the nozzle is manufactured or according to a user's need.

Exemplary embodiments of the present invention directed to the method in which the control unit 510 selects each print position from the adjacent print positions and from the interest region to exchange image data will be described in detail with reference to FIGS. 6 through 11.

The control unit 510 generates a control signal having information of a driving status for each nozzle using the exchanged image data and transmits the control signal to the nozzle driving unit 530. The nozzle driving unit 530 drives each of the nozzles in response to the control signal. Accordingly, the colors of the dots printed on the two print positions are exchanged because of the exchange of the image data of the two print positions.

In an inkjet image forming apparatus 125, the control unit 510 binarizes inputted image data using a halftoning transaction, and then generates a control signal for determining respective ink ejection of the plurality of nozzles. The control unit 510 can exchange the binarized image data according to the above-described manner.

The halftoning transaction is used as an image processing method employed in an apparatus treating restricted tone values, and reduces a quantized tone per pixel but prints an image similarly to an original image. For example, the halftoning transaction can convert 8-bit image data (0 through 255) to 1-bit binary data (0 or 1). When a print position has image data of cyan (C), magenta (M), yellow (Y), or black (K) represented by 8-bit image data (0 through 255), the image data is binarized using the halftoning transaction, and then image data having information of ink ejection status for each nozzle on the print position corresponding to each of the four colors (C, M, Y & K).

Exemplary embodiments of the present invention providing a method and apparatus for compensating for a malfunctioning nozzle in the inkjet image forming apparatus 125 will be described in reference to FIGS. 6 through 11 in which the control unit 510 exchanges image data of a print position adjacent to a compensation position for image data of a print position in an interest region.

Figure 6:
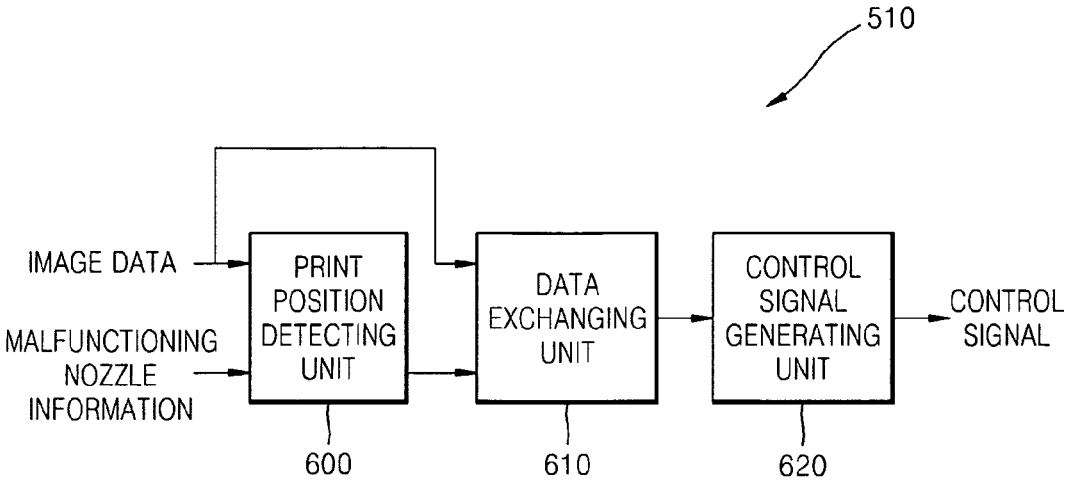
FIG. 6 is a block diagram illustrating a control unit of the exemplary embodiment of FIG. 5 according to an exemplary embodiment of the present invention.

FIG. 6 is a block diagram illustrating the control unit according to an exemplary embodiment of the present invention. The control unit 510 includes a print position detecting unit 600, a data exchanging unit 610, and a control signal generating unit 620. The operation of the control unit 510 will be described in conjunction with an exemplary embodiment of the present invention providing a method of compensating for a manufacturing nozzle illustrated in FIG. 11.

The print position detecting unit 600 determines a first print position among a plurality of print positions in the interest region for the exchange of image data in step 1100. The print position detecting unit 600 can analyze image information of image data of each print position in the interest region to determine the first print position.

The print position detecting unit 600 determines a second print position among print positions adjacent to a compensation position for the exchange of image data in step 1110. The print position detecting unit 600 can analyze image information of image data of each print position adjacent to the compensation position to determine the second print position. The adjacent print positions can be disposed to the left, right, above, and below the compensation position. In addition, the first print position can be selected from print positions in the interest region except for the compensation position and the print positions adjacent to the compensation position.

The data exchanging unit 610 exchanges the image data of the first print position for the image data of the second print position in step 1120. The control signal generating unit 620 generates a control signal driving nozzles using the exchanged image data in step 1130.

Figure 8A:
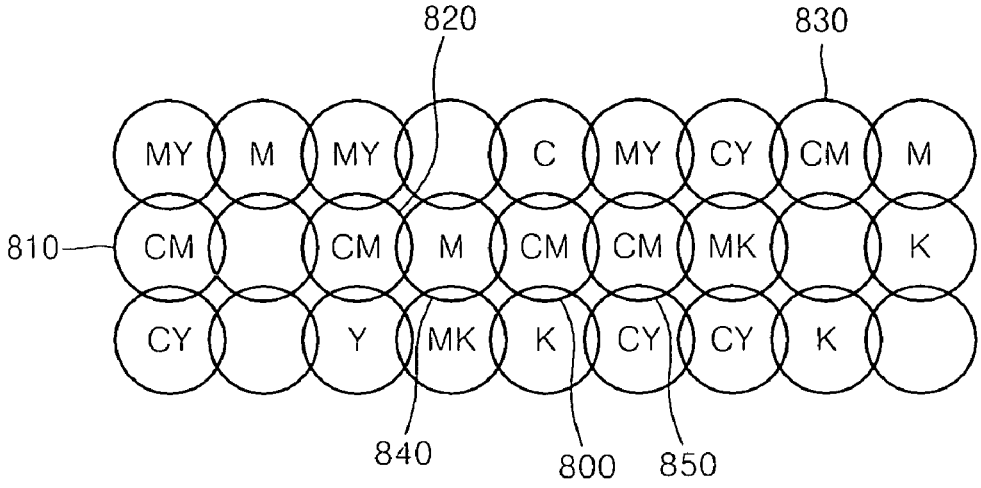
FIGS. 8A and 8B illustrate a method of exchanging image data of a print position adjacent to a compensation position for image data of a print position in an interest region, according to an exemplary embodiment of the present invention.
Figure 8B:
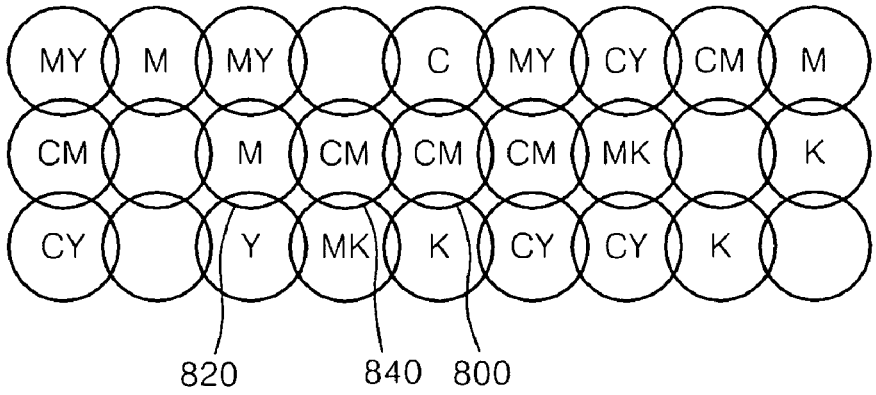

FIGS. 8A and 8B illustrate a method of exchanging image data of a first print position adjacent to a compensation position 800 for image data of a second print position in an interest region, according to an exemplary embodiment of the present invention. Circles in FIGS. 8A and 8B denote print positions, and colors to be printed at each print position are written in the circles. Referring to FIG. 8A, when colors to be printed in the compensation position 800 are cyan and magenta (CM) and a color printed by a malfunctioning nozzle is magenta (M), the compensation position regularly shows the cyan color but does not show the magenta color, thereby deteriorating printing quality.

FIG. 8A illustrates print positions in the interest region near the compensation position 800 and exemplary colors printed on the print positions. The print position detecting unit 600 detects among the print positions in the interest region a print position having the same color of the compensation position 800 and selects it as a first print position for exchanging image data. When two or more print positions have the same color as the compensation position 800, one of them may be selected.

Referring to FIG. 8A, four print positions 810, 820, 830, and 850 in the interest region have the same color as the compensation position 800. The print position 850 may not be selected because it is adjacent to the compensation position 800. Accordingly, the print position detecting unit 600 arbitrarily selects one print position among the print positions 810, 820, and 830 for the first print position.

The print position detecting unit 600 can select the second print position for exchanging the image data from the print position 840 leftward adjacent to the compensation position 800 and the print position 850 rightward adjacent to the compensation position 800. The print position detecting unit 600 can select a print position having a different color from the compensation position 800 from print positions 840 and 850 leftward and rightward adjacent to the compensation position 800 as a sixth print position.

FIG. 8B illustrates the results when the image data of the first and second print positions of FIG. 8A are exchanged using the above-described exchanging method. That is, FIG. 8B illustrates the results that the image data of the first print position 820, which is arbitrarily selected by the data exchanging unit 610 from the print positions having the same color of the compensation position 800 in the interest region, is exchanged for the image data of the second print position 840, which is selected from the print positions 840 and 850 leftward and rightward adjacent to the compensation position 800 and having a different color from that of compensation position 800.

By exchanging image data as described above, the print position leftward or rightward adjacent to the compensation position 800 is printed in a color that is printed at the compensation position 800, thereby reducing the degradation of printing quality caused by the malfunctioning nozzle.

Figure 9A:
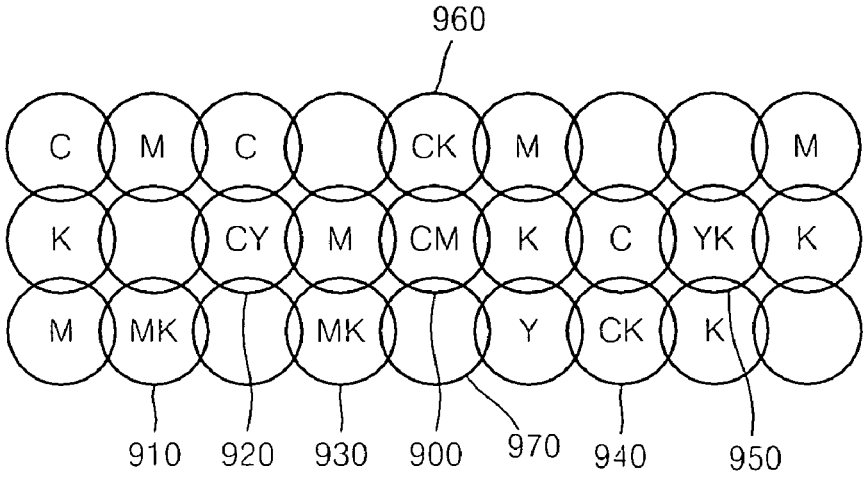
FIGS. 9A and 9B illustrate a method of exchanging image data of a print position adjacent to a compensation position for image data of a print position in an interest region, according to another exemplary embodiment of the present invention.
Figure 9B:
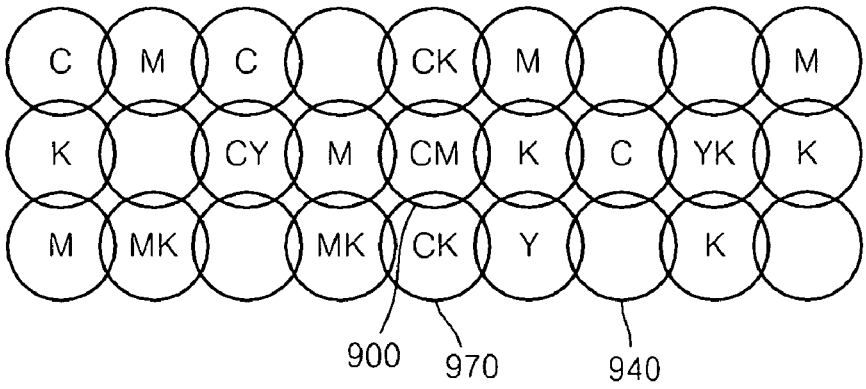

FIGS. 9A and 9B illustrate a method of exchanging image data of a third print position adjacent to a compensation position 900 for image data of a fourth print position in an interest region, according to another exemplary embodiment of the present invention. Referring to FIG. 9A, colors to be printed at the compensation position 900 are cyan and magenta (CM) and a color printed by the malfunctioning nozzle is magenta (M).

FIG. 9A illustrates print positions in the interest region near the compensation position 900 and colors printed at the print positions. The print position detecting unit 600 detects among the print positions in the interest region a print position that has a different color from the compensation position 900 and does not have a single color, such as white, cyan, magenta, or yellow, and selects it as a third print position for exchanging image data. When two or more print positions in the interest region satisfy the above-described conditions, the print position detecting unit 600 may select one of the print positions.

Referring to FIG. 9A, seven print positions 900, 910, 920, 930, 940, 950, and 960 in the interest region satisfy the above-described conditions. The compensation position 900 and the adjacent print position 960 may not be selected. Accordingly, the print position detecting unit 600 arbitrarily selects one print position among the print positions 910, 920, 930, 940, and 950 for the third print position.

The print position detecting unit 600 may select a fourth print position for exchanging image data from the print position 960 upward adjacent to the compensation position 900 and the print position 970 downward adjacent to the compensation position 900. The print position detecting unit 600 may select a print position having the color white, cyan, magenta, or yellow color from the print positions 960 and 970 upward and downward adjacent to the compensation position 900 as the fourth print position FIG. 9B illustrates the result when the image data of the third and fourth print positions of FIG. 9A are exchanged using the above-described exchanging method. That is, FIG. 9B illustrates the result that the image data of the third print position 940, which is arbitrarily selected by the data exchanging unit 610 from the print positions satisfying the above-described conditions in the interest region, is exchanged for the image data of the fourth print position 970, which is selected from the print positions 960 and 970 upward and downward adjacent to the compensation position 900 and having a white color.

By exchanging the image data as described above, the print position upward or downward adjacent to the compensation position 900 is printed in a color that is not a bright color such as white, cyan, magenta, or yellow, thereby reducing the degradation of printing quality due to the white band caused by the malfunctioning nozzle.

The above-described method of selecting the third and fourth print positions for exchanging image data can be performed when a print position having the same color of the compensation position 900 does not exist in the interest region, as illustrated in FIG. 9A. Alternatively, when a print position having the same color of the compensation position 900 exists in the interest region, the method of selecting the first and second print position for exchanging the image data, as illustrated in FIGS. 8A and 8B, can be performed.

Figure 10A:
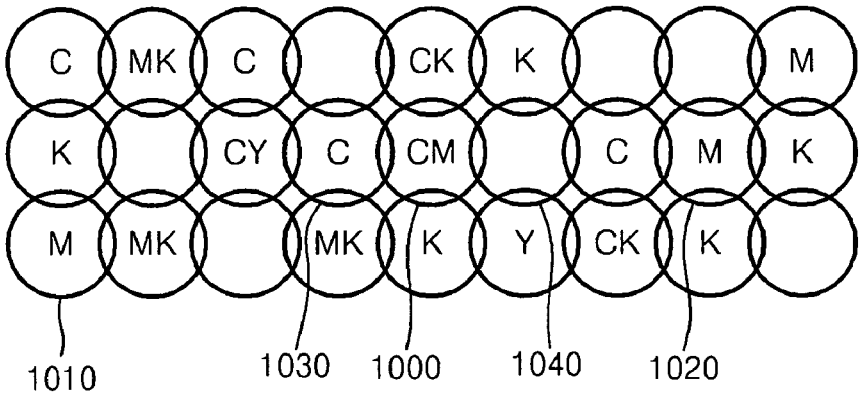
FIGS. 10A and 10B illustrate a method of exchanging image data of a print position adjacent to a compensation position for image data of a print position in an interest region, according to an exemplary embodiment of the present invention.
Figure 10B:
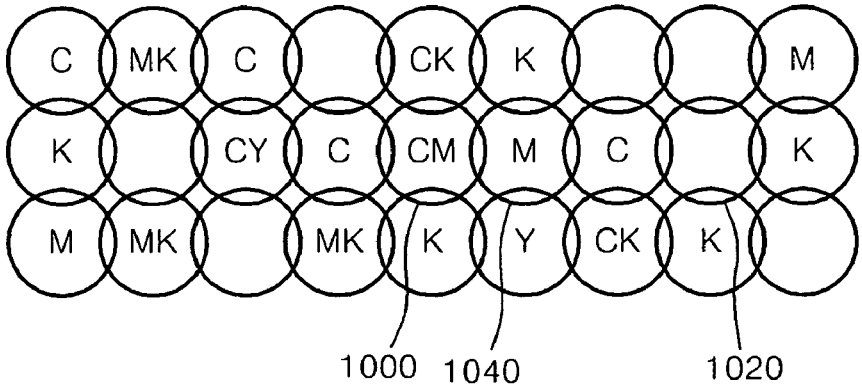
Figure 11:
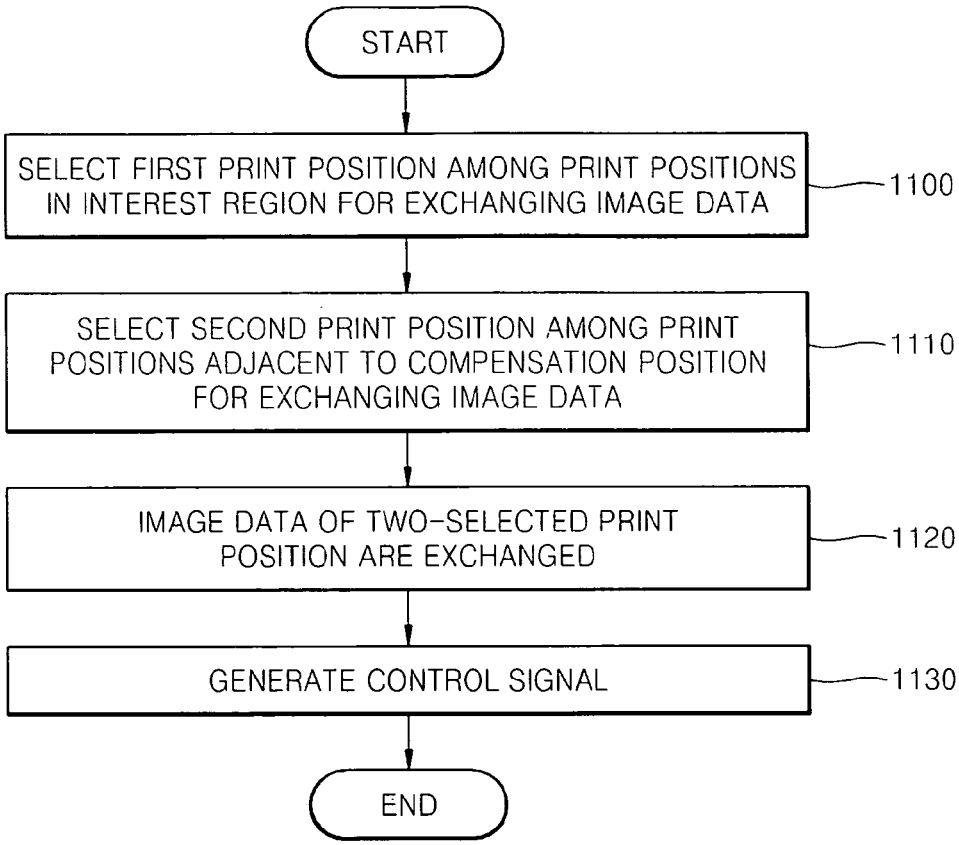
FIG. 11 is a flow chart of a method of compensating for a malfunctioning nozzle according to an exemplary embodiment of the present invention.

FIGS. 10A and 10B illustrate a method of exchanging image data of a fifth print position adjacent to a compensation position 1000 for image data of a sixth print position in an interest region, according to an exemplary embodiment of the present invention. Referring to FIG. 10A, colors to be printed in the compensation position 1000 are cyan and magenta (CM) and a color printed by a malfunctioning nozzle is magenta (M).

The print position detecting unit 600 detects among the print positions in the interest region a print position having the same color as that which the malfunctioning nozzle prints, and selects it as a fifth print position for exchanging image data. When two or more print positions in the interest region have the same color as that which the malfunctioning nozzle prints, the print position detecting unit 600 may select one of the print positions.

Referring to FIG. 10A, two print positions 1010 and 1020 in the interest region are printed in magenta (M), and one print position 1030 in the interest region is printed in cyan (C). The print position detecting unit 600 selects one print position among the print positions 1010, 1020, and 1030 for the fifth print position.

The print position detecting unit 600 may select a sixth print position for exchanging image data from the print position 1030 leftward adjacent to the compensation position 1000 and the print position 1040 rightward adjacent to the compensation position 1000. The print position detecting unit 600 may select a print position having a white color from the print positions 1030 and 1040 leftward and rightward adjacent to the compensation position 1000 as the sixth print position.

FIG. 10B illustrates the result when the image data of the fifth and sixth print positions of FIG. 10A are exchanged using the above-described exchanging method. That is, FIG. 10B illustrates the result when the image data of the fifth print position 1020, which is arbitrarily selected by the data exchanging unit 610 from the print positions in the interest region having the color magenta color, is exchanged for the image data of the sixth print position 1040, which is selected from the print positions 1030 and 1040 leftward and rightward adjacent to the compensation position 1000 and having a white color. By the exchange of the image data as described above, a cyan color is regularly printed on the compensation position 1000, and a magenta color is irregularly printed on the print position 1040 rightward adjacent to the compensation position 1000.

By exchanging the image data as described above, the print position leftward or rightward adjacent to the compensation position 1000 is printed in a color that is irregularly printed in the compensation position 1000, thereby reducing the degradation of printing quality caused by the malfunctioning nozzle.

The above-described method of selecting the fifth and sixth print positions for exchanging image data can be performed when a print position having the same color as the compensation position 1000 does not exist in the interest region, as illustrated in FIG. 10A. In addition, this method can be performed when print positions upward and downward adjacent to the compensation position 1000 does not have white, cyan, magenta, or yellow color.

Exemplary embodiments of the present invention can also be embodied as computer readable code on a computer readable recording medium. The computer readable medium comprises any data storage device that can store data which can be thereafter read by computer system. Examples of the computer readable medium include read-only memory (ROM), random-access memory (ROM), CD-ROM, magnetic tape, floppy disk, optical data storage devices, and carrier waves (such as data transmission through the Internet).

As described above, when an image is printed using the method and apparatus for compensating for a malfunctioning nozzle in an inkjet image forming apparatus according to exemplary embodiments of the present invention, image data of a print position adjacent to a compensation position printed by a malfunctioning nozzle is exchanged for image data of a print position in an inspection region near the compensation position. Accordingly, degradation of print quality, such as, for example, an unintentional visible white band, can be prevented and the lifetime of the printhead can be lengthened because of the compensation for the malfunctioning nozzle.

While the present invention has been particularly shown and described with reference to certain exemplary embodiments thereof, it will be understood by those of ordinary skill in the art that various changes in form and detail may be made therein without departing from the spirit and scope of the present invention as defined by the following claims and equivalents thereof.

What is claimed is:

1. A method of compensating for a malfunctioning nozzle of an inkjet image forming apparatus, the method comprising:

detecting a malfunctioning nozzle in an inkjet image forming apparatus having a plurality of nozzles; and exchanging image data of a print position adjacent to a compensation position printed by the malfunctioning nozzle for image data of a print position in an interest region near the compensation position:

wherein the exchanging of image data comprises:

detecting among a plurality of print positions in the interest region a print position having the same color as the compensation position; and exchanging image data of the detected print position for image data of one of the adjacent print positions leftward and rightward of the compensation position.

2. The method of claim 1, wherein the print position adjacent to the compensation position has a different color from the compensation position and one of the adjacent print positions leftward and rightward of the compensation position.

3. An apparatus for compensating for a malfunctioning nozzle of an inkjet image forming apparatus, the apparatus comprising:

a malfunctioning nozzle detecting unit for detecting a malfunctioning nozzle among a plurality of nozzles; and a control unit for exchanging image data of a print position adjacent to a compensation position printed by the malfunctioning nozzle for image data of a print position in an interest region near the compensation position;

wherein the control unit comprises:

a print position detecting unit for detecting among a plurality of print positions in the interest region a print position having the same color as the compensation position; and a data exchanging unit for exchanging image data of the detected print position for image data of one of the adjacent print positions leftward and rightward of the compensation position.

4. The apparatus of claim 3, wherein the print position adjacent to the compensation position has a different color from the compensation position and one of the adjacent print positions leftward and rightward of the compensation position.

5. An image forming apparatus for receiving image data and printing an image using a plurality of nozzles, the image forming apparatus comprising:

a printhead comprising a plurality of nozzles that eject ink to form an image on a print medium;

a malfunctioning nozzle detecting unit for detecting a malfunctioning nozzle among the plurality of nozzles;

a control unit for exchanging image data of a print position adjacent to a compensation position printed by the malfunctioning nozzle for image data of a print position in an interest region near the compensation position, and for generating a control signal for driving the plurality of nozzles in response to the exchanged image data; and a nozzle driving unit for driving the plurality of nozzles in response to the generated control signal;

wherein the control unit comprises:

a print position detecting unit for detecting among a plurality of print positions in the interest region a print position having the same color as the compensation position; and a data exchanging unit for exchanging image data of the detected print position for image data of one of the adjacent print positions leftward and rightward of the compensation position.

6. A computer-readable medium having stored thereon a computer program for implementing the method of claim 1.

* * * * *

UNITED STATES PATENT AND TRADEMARK OFFICE

CERTIFICATE OF CORRECTION

PATENT NO. : 7,604,316 B2
APPLICATION NO. : 11/582435
DATED : October 20, 2009
INVENTOR(S) : Terekhov et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 249 days.

Signed and Sealed this

Fifth Day of October, 2010

David J. Kappos

David J. Kappos
*Director of the United States Patent and Trademark Office*